US009824657B2

(12) United States Patent
Zhang et al.

(10) Patent No.: US 9,824,657 B2
(45) Date of Patent: Nov. 21, 2017

(54) GATE DRIVING CIRCUIT AND LIQUID CRYSTAL DISPLAY

(71) Applicant: Shenzhen China Star Optoelectronics Technology Co., Ltd., Shenzhen, Guangdong (CN)

(72) Inventors: Xianming Zhang, Guangdong (CN); Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 111 days.

(21) Appl. No.: 14/787,541

(22) PCT Filed: Aug. 21, 2015

(86) PCT No.: PCT/CN2015/087819

§ 371 (c)(1),
(2) Date: Oct. 28, 2015

(87) PCT Pub. No.: WO2017/016013

PCT Pub. Date: Feb. 2, 2017

(65) Prior Publication Data

US 2017/0162155 A1 Jun. 8, 2017

(30) Foreign Application Priority Data

Jul. 24, 2015 (CN) ..... 2015 1 0444321

(51) Int. Cl.
*G09G 3/36* (2006.01)

(52) U.S. Cl.
CPC ... *G09G 3/3677* (2013.01); *G09G 2300/0809* (2013.01); *G09G 2310/0289* (2013.01)

(58) Field of Classification Search
CPC .. G09G 3/3648; G09G 3/3674; G09G 3/3696; G09G 2300/0426;
(Continued)

(56) References Cited

U.S. PATENT DOCUMENTS

2011/0181573 A1* 7/2011 Lee ..... G09G 3/3611 345/211
2013/0044085 A1 2/2013 Lin
(Continued)

FOREIGN PATENT DOCUMENTS

CN 1499705 A 5/2004
CN 1758323 A 4/2006
(Continued)

*Primary Examiner* — Md Saiful A Siddiqui
(74) *Attorney, Agent, or Firm* — Andrew C. Cheng

(57) ABSTRACT

A gate driving circuit and a liquid crystal display are provided, wherein the gate driving circuit comprises a gate pulse modulator and a controlling circuit, the controlling circuit comprises at least one sub controlling circuit; an input terminal of each sub controlling circuit of the at least one sub controlling circuit is connected to an output terminal of the gate pulse modulator; an output terminal of each sub controlling circuit is connected to a power source; the power source outputs a level signal to each sub controlling circuit; each sub controlling circuit controls a conduction between each sub controlling circuit and the gate pulse modulator according to the level signal, so as to control the gate driving circuit to output at least one gate driving voltage. The present disclosure may generate a plurality of gate driving voltages, thereby increasing the display effect of the liquid crystal display.

4 Claims, 6 Drawing Sheets

(58) Field of Classification Search
CPC ..... G09G 2330/021; G09G 2310/0286; G09G 2310/08; G09G 3/3677
See application file for complete search history.

(56) References Cited

U.S. PATENT DOCUMENTS

| | | | | |
|---|---|---|---|---|
| 2014/0145922 | A1 | 5/2014 | Chen | |
| 2014/0168181 | A1* | 6/2014 | Furuta | G11C 19/28 345/205 |
| 2014/0184482 | A1* | 7/2014 | Zhang | G09G 3/3406 345/87 |
| 2015/0318849 | A1* | 11/2015 | Wu | H03K 17/28 327/393 |

FOREIGN PATENT DOCUMENTS

| | | | |
|---|---|---|---|
| CN | 101242137 | A | 8/2008 |
| CN | 101699552 | A | 4/2010 |
| CN | 102136247 | A | 7/2011 |
| CN | 103198779 | A | 7/2013 |
| CN | 103258515 | A | 8/2013 |
| CN | 104332148 | A | 2/2015 |
| CN | 104599647 | A | 5/2015 |
| CN | 104732941 | A | 6/2015 |
| JP | H0844310 | A | 2/1996 |
| JP | H1165506 | A | 3/1999 |

* cited by examiner

GATE DRIVING CIRCUIT AND LIQUID CRYSTAL DISPLAY

CROSS REFERENCE

This application claims the benefit of, and priority to, Chinese Patent Application No. 201510444321.5, filed Jul. 24, 2015, titled "Gate Driving Circuit And Liquid Crystal Display", the entire contents of which are incorporated by reference herein in its entirety.

FIELD OF THE INVENTION

The disclosure is related to communication technology field, and more particular to a gate driving circuit and a liquid crystal display.

BACKGROUND OF THE INVENTION

Currently, the development of the liquid crystal display device exhibits development trend of high integration level and low cost. The application of the liquid crystal display (LCD) has been very broad, such the field of computer, television and so on. The display of the liquid crystal display is achieved by the driving circuit. The liquid crystal display includes a gate driving circuit, a source driving circuit and a pixel area. In the existing technique solution, the gate driving circuit adopts the gate pulse modulator (GPM) to generate a gate driving voltage, and in this way, it can only generate a gate driving voltage. However, for the special frame or 3D mode which needs a variety of gate driving voltages, the GPM method can not generate a variety of gate driving voltages. This affects the display effect of the liquid crystal display.

SUMMARY OF THE INVENTION

An embodiment of the present disclosure provides a gate driving circuit and a liquid crystal display, thereby generating a variety of gate driving voltages, thus increasing the display effect of the liquid crystal display.

A first aspect of an embodiment of the present disclosure provides a gate driving circuit, including:

a controlling circuit; the controlling circuit includes at least one sub controlling circuit; an input terminal of each sub controlling circuit of the at least one sub controlling circuit is connected to an output terminal of the gate pulse modulator; an output terminal of each sub controlling circuit is connected to a power source;

the power source outputs a level signal to each sub controlling circuit; each sub controlling circuit controls a conduction between each sub controlling circuit and the gate pulse modulator according to the level signal, so as to control the gate driving circuit to output at least one gate driving voltage.

In one embodiment, each sub controlling circuit of the at least one sub controlling circuit includes a first voltage division resistor and a first field effect transistor.

In one embodiment, an input terminal of the first voltage division resistor is connected to the output terminal of the gate pulse modulator, an output terminal of the first voltage division resistor is connected to a drain of the first field effect transistor, a source of the first field effect transistor is connected to a ground, and a gate of the first field effect transistor is connected to the power source.

In one embodiment, the first field effect transistor is N channel depletion type field effect transistor.

In one embodiment, when the level signal outputted to each sub controlling circuit from the power source is greater than or equals to a conducting threshold of the first field effect transistor, the first field effect transistor is in a conducting state, and the first voltage division resistor is connected to the gate pulse modulator; when the level signal outputted to each sub controlling circuit from the power source is less than a conducting threshold of the first field effect transistor, the first field effect transistor is in a cut-off state, and the first voltage division resistor is disconnected from the gate pulse modulator.

In one embodiment, each sub controlling circuit of the at least one sub controlling circuit further includes a second voltage division resistor and a second field effect transistor.

In one embodiment, an input terminal of the first voltage division resistor is connected to the output terminal of the gate pulse modulator, an output terminal of the first voltage division resistor is connected to a drain of the second field effect transistor, a source of the second field effect transistor is connected to a ground, a gate of the second field effect transistor is connected to a drain of the first field effect transistor, a source of the first field effect transistor is connected to a ground, a gate of the first field effect transistor is connected to the power source, an output of the second voltage division resistor is connected to the drain of the first field effect transistor, and an input terminal of the second voltage division resistor is connected to the power source.

In one embodiment, the first field effect transistor and the second field effect transistor are N channel depletion type field effect transistor.

In one embodiment, the power source outputs a constant voltage to the second voltage division resistor, and the constant voltage is greater than or equals to a conducting threshold of the second field effect transistor.

In one embodiment, when the level signal of each sub controlling circuit is greater than or equals to a conducting threshold of the first field effect transistor, the first field effect transistor is in a conducting state, the second field effect transistor is in a cut-off state, and the first voltage division resistor is disconnected from the gate pulse modulator; when the level signal of each sub controlling circuit is less than a conducting threshold of the first field effect transistor, the first field effect transistor is in a cut-off state, and the second field effect transistor is in a conducting state, the first voltage division resistor is connected to the gate pulse modulator.

In one embodiment, the level signal outputted to each sub controlling circuit from the power source is the same.

A second aspect of an embodiment of the present disclosure provides a liquid crystal display, including the gate driving circuit provided by the first aspect.

In the embodiments of the present disclosure, a plurality of sub controlling circuits is configured. Each sub controlling circuit controls a conduction between each controlling circuit and the pulse voltage modulator according to the level signal outputted by the power source, so as to control the gate driving circuit to output a plurality of gate driving voltages, thereby increasing the display effect of the liquid crystal display.

BRIEF DESCRIPTION OF THE DRAWINGS

In order to more clearly illustrate the embodiments or the prior art technical solutions embodiment of the present disclosure, it will implement the following figures for the cases described in the prior art or require the use of a simple introduction, Obviously, in the following description The drawings are only some embodiments of the present disclosure, those having ordinary skills in the related art, without creative efforts, can also obtain other drawings based on these drawings.

DETAILED DESCRIPTION OF PREFERRED EMBODIMENTS

The present disclosure will now be combined with the implementation of the drawings, were a clear example of the technical solutions of the present disclosure a complete description of, obviously, the described embodiments are only part of the embodiments of the present disclosure but not all embodiments. Based on the embodiments of the present disclosure all other embodiments by those of ordinary skill in the creative work did not make the premise obtained are within the scope of protection of the present disclosure.

Figure 1:
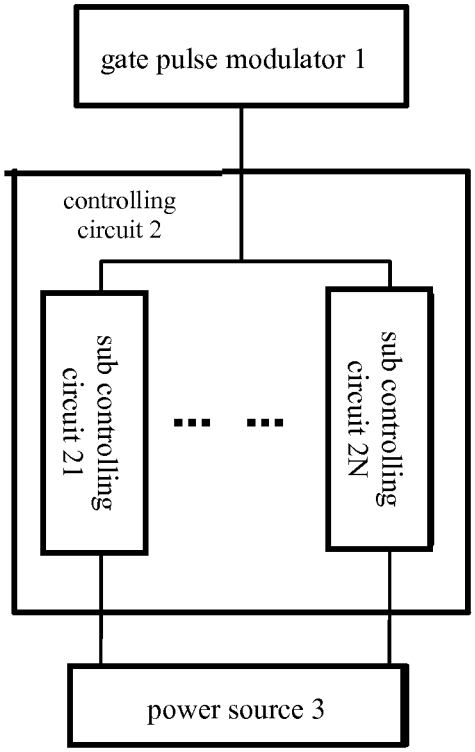
FIG. 1 is a schematic view of a gate driving circuit according to an embodiment of the present disclosure.

Please refer to FIG. 1. FIG. 1 is a schematic view of a gate driving circuit according to an embodiment of the present disclosure. As shown in FIG. 1, the gate driving circuit includes a gate pulse modulator 1, a controlling circuit 2, and a power source 3. The controlling circuit 2 includes N sub controlling circuits, such as sub controlling circuit 21, . . . , sub controlling circuit 2N, etc., wherein N is a positive integer which is greater than or equals to 1, and a connecting manner of each sub controlling circuit is the same. The description for the sub controlling circuit 21 is given in details as follows.

An input terminal of the sub controlling circuit 21 is connected to an output terminal of the gate pulse modulator 1, and an output terminal of the sub controlling circuit 21 is connected to the power source 3.

The power source 3 outputs a level signal to the sub controlling circuit 21, the sub controlling circuit 21 controls a conduction between the sub controlling circuit 21 and the gate pulse modulator 1 according to the level signal, so as to control the gate driving circuit to output at least one gate driving voltage.

It should be noted that the liquid crystal display includes the gate driving circuit, and the gate driving circuit can generate a desired gate drive voltage of the liquid crystal display. The gate driving circuit includes the gate pulse modulator 1, the gate pulse modulator 1 is an implementation of a conventional gate driving circuit, by inputting a high level voltage to the gate pulse modulator 1, thereby generating a gate driving voltage. A variety of gate driving voltages may be generated by connecting the controlling circuit 2 and the output terminal of the gate pulse modulator 1. Specifically, each sub controlling circuit controls conduction between each sub controlling circuit and the gate pulse modulator 1 according to the level signal outputted by the power source, so as to control the gate driving circuit to output a plurality of gate driving voltages.

In the embodiment of the present disclosure, a plurality of sub controlling circuits is configured. Each sub controlling circuit controls a conduction between each controlling circuit and the pulse voltage modulator according to the level signal outputted by the power source, so as to control the gate driving circuit to output a plurality of gate driving voltages, thereby increasing the display effect of the liquid crystal display.

Figure 2:
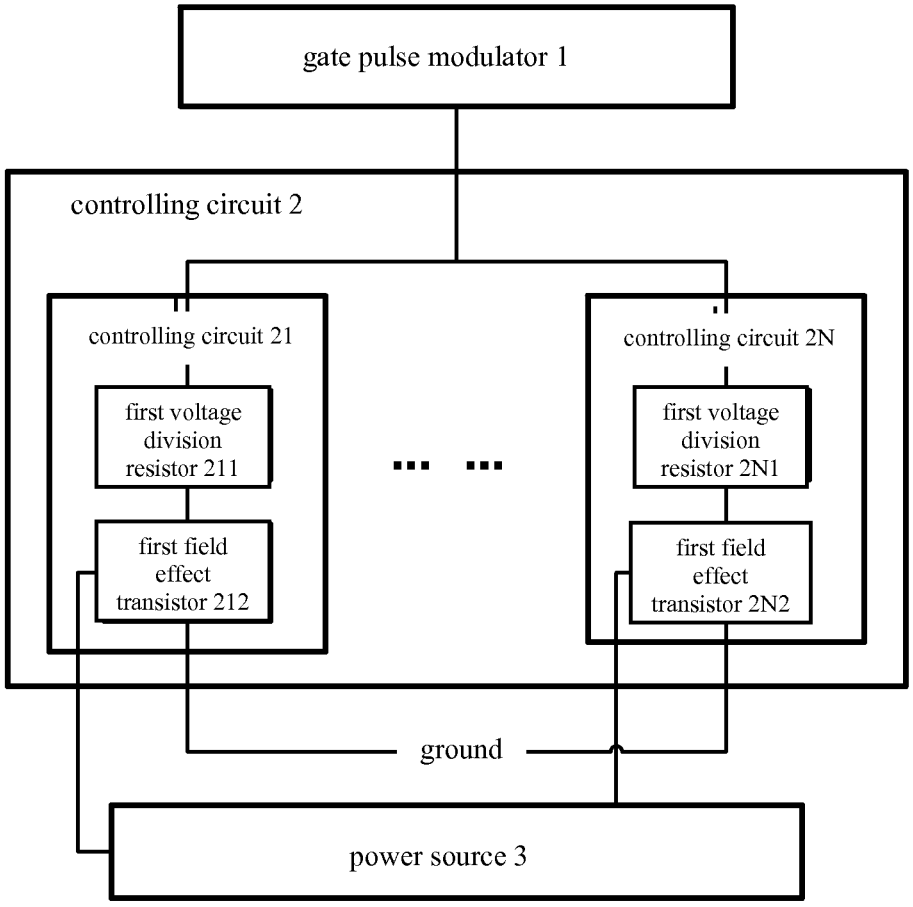
FIG. 2 is a schematic view of another gate driving circuit according to an embodiment of the present disclosure.

Please refer to FIG. 2. FIG. 2 is a schematic view of another gate driving circuit according to an embodiment of the present disclosure. As shown in FIG. 2, the gate driving circuit includes a gate pulse modulator 1, a controlling circuit 2, and a power source 3. The controlling circuit 2 includes N sub controlling circuits, such as sub controlling circuit 21, . . . , sub controlling circuit 2N, etc., wherein N is a positive integer which is greater than or equals to 1. Each sub controlling circuit includes a first voltage division resistor and a first field effect transistor, such as the sub controlling circuit 21 includes a first voltage division resistor 211 and a first field effect transistor 212, and a connecting manner of each sub controlling circuit is the same. The description for the sub controlling circuit 21 is given in details as follows.

An input terminal of the first voltage division resistor 211 is connected to the output terminal of the gate pulse modulator 1, an output terminal of the first voltage division resistor 211 is connected to a drain of the first field effect transistor 212, a source of the first field effect transistor 212 is connected to a ground, and a gate of the first field effect transistor 212 is connected to the power source 3.

The first field effect transistor 212 is N channel depletion type field effect transistor. Specifically, when the level signal outputted to the sub controlling circuit 21 from the power source 3 is greater than or equals to a conducting threshold of the first field effect transistor 212, the first field effect transistor 212 is in a conducting state, and the first voltage division resistor 211 is connected to the gate pulse modulator 1; when the level signal outputted to the sub controlling circuit 21 from the power source 3 is less than a conducting threshold of the first field effect transistor 212, the first field effect transistor 212 is in a cut-off state, and the first voltage division resistor 211 is disconnected from the gate pulse modulator 1.

It should be noted that the liquid crystal display includes the gate driving circuit, and the gate driving circuit can generate a desired gate drive voltage of the liquid crystal display. The gate driving circuit includes the gate pulse modulator 1, the gate pulse modulator 1 is an implementation of a conventional gate driving circuit, by inputting a high level voltage to the gate pulse modulator 1, thereby generating a gate driving voltage. Specifically, the level signal outputted to each sub controlling circuit from the power source is the same, the first voltage division resistor of each sub controlling circuit is disconnected from and is connected to the gate pulse modulator 1 at the same time to generate two gate driving voltages. Or, the power source 3 may output different level signals to N sub controlling circuits included in the controlling circuit. It may control the first voltage division resistors in different sub controlling circuits to disconnect from and connect to the gate pulse modulator 1, thereby controlling the gate driving circuit to output a plurality of driving voltages.

In an embodiment of the present disclosure, a plurality of sub controlling circuits is configured. Each sub controlling circuit controls a conduction between each controlling circuit and the pulse voltage modulator according to the level signal outputted by the power source, so as to control the gate driving circuit to output a plurality of gate driving voltages, thereby increasing the display effect of the liquid crystal display.

Figure 3:
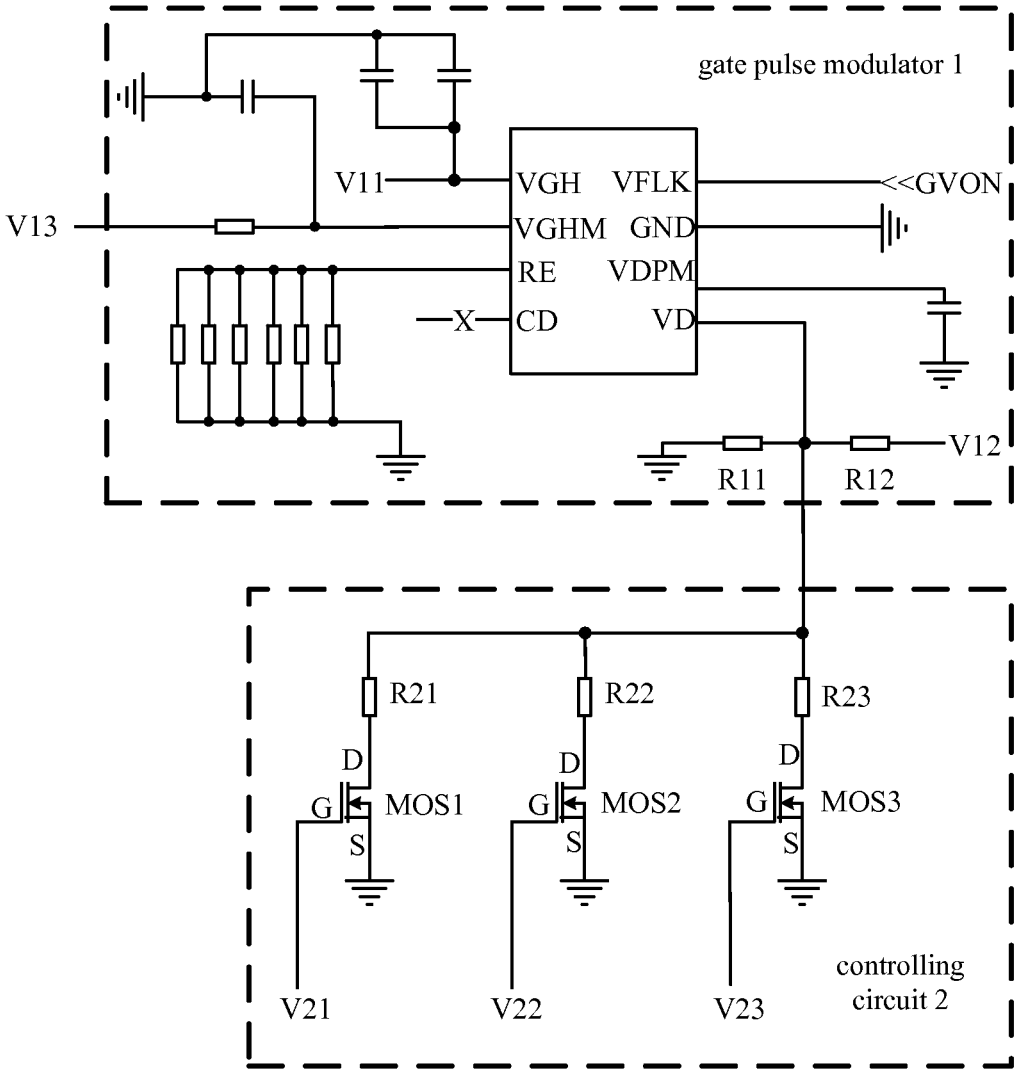
FIG. 3 is a circuit diagram of a gate driving circuit according to an embodiment of the present disclosure.

Please refer to FIG. 3. FIG. 3 is a circuit diagram of a gate driving circuit according to an embodiment of the present disclosure. As shown in FIG. 3, it is a circuit diagram of a gate driving circuit provided by a schematic view of the gate driving circuit as shown in FIG. 2. The gate driving circuit includes a gate pulse modulator 1 and a controlling circuit 2. The controlling circuit 2 includes three sub controlling circuits, which includes: a first sub controlling circuit MOS1 and R21, a second sub controlling circuit MOS2 and R22 and a third sub controlling circuit MOS3 and R23, wherein MOS1, MOS2, and MOS3 are N channel depletion type field effect transistor.

The gate pulse modulator 1 is an implementation of a conventional gate driving circuit, by inputting a high level voltage V11 to the whole gate pulse modulator 1, thereby generating a gate driving voltage V13, and a magnitude of V13 is determined according to the voltage division resistors R11 and R12. Therefore, the present disclosure adopts to change the division resistors of the whole gate driving circuit, thereby changing the gate driving voltage V13. A common node of the R11 and R12 in the gate pulse modulator 1 is selected as the output terminal of the gate pulse modulator 1.

Input terminals of R21, R22 and R23 are connected to the common node of R11 and R12, an output terminal of R21 is connected to a drain D of MOS1, a source S of MOS1 is connected to a ground, and a gate G of MOS1 is connected to V21. An output terminal of R22 is connected to a drain D of MOS2, a source S of MOS2 is connected to a ground, and a gate G of MOS2 is connected to V22. An output terminal of R23 is connected to a drain D of MOS3, source S of MOS3 is connected to a ground, and a gate G of MOS3 is connected to V23. V21, V22, V23 are the level signal inputted by the corresponding field effect transistors.

The conduction threshold of standard N channel MOS transistor is in the range of 3V~6V and the conduction thresholds of MOS1, MOS2 and MOS3 are assumed as 3V. When V21 is 3.3V, V22 is 0V and V23 is 0V, MOS1 conducts, MOS2 cuts-off and MOS3 cuts-off, i.e. R21 is connected to a ground, R22 and R23 are disconnected; therefore R21 is connected to the gate pulse modulator 1, so as to generate one gate driving voltage V13. When V21 is 3.3V, V22 is 3.3V and V23 is 0V, MOS1 conducts, MOS2 conducts, and MOS3 cuts-off, i.e. R21 is connected to a ground, R22 is connected to a ground, R23 is disconnected, R21 is connected to the gate pulse modulator 1, so as to generate another gate driving voltage V13. The above example is merely an embodiment of the present disclosure, and thus the enumeration is omitted. It should be understood that the gate driving circuit can further set different level signals for V21, V22, and V23, thereby generating different gate drive voltages V13.

In the embodiment of the present disclosure, a plurality of sub controlling circuits is configured. Each sub controlling circuit controls a conduction between each controlling circuit and the pulse voltage modulator according to the level signal outputted by the power source, so as to control the gate driving circuit to output a plurality of gate driving voltages, thereby increasing the display effect of the liquid crystal display.

Figure 4:
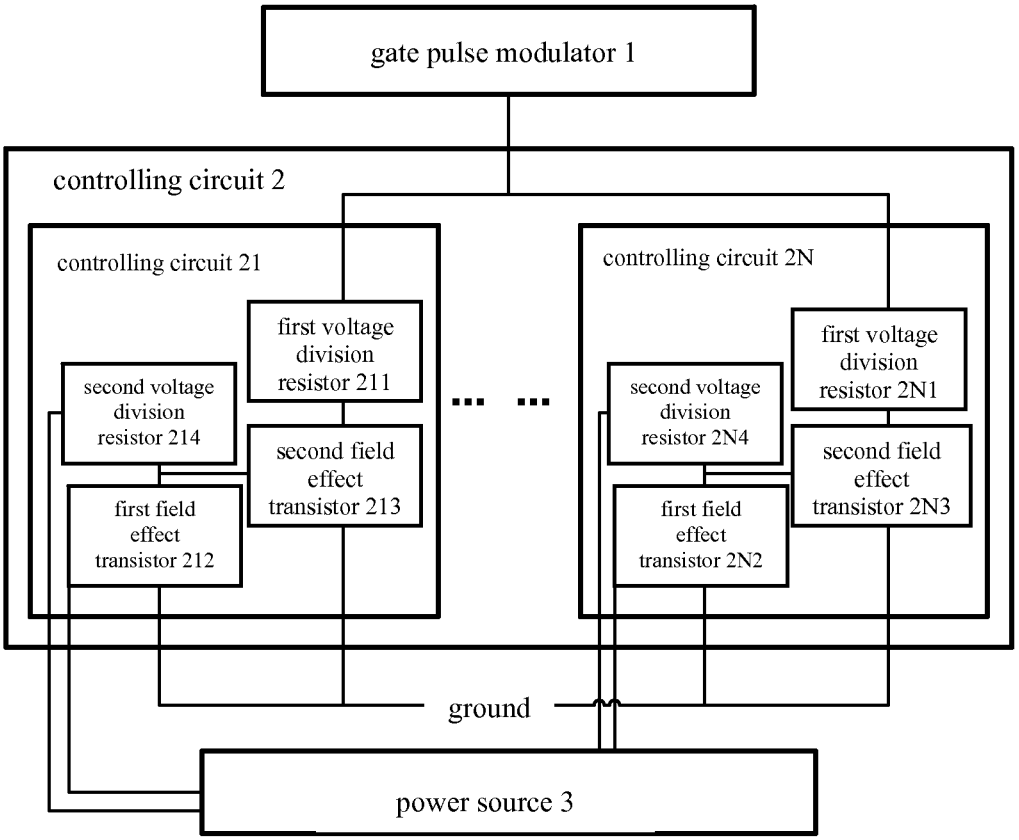
FIG. 4 is a schematic view of another gate driving circuit according to an embodiment of the present disclosure.

Please refer to FIG. 4. FIG. 4 is a schematic view of another gate driving circuit according to an embodiment of the present disclosure. As shown in FIG. 4, the gate driving circuit includes a gate pulse modulator 1, a controlling circuit 2, and a power source 3. The controlling circuit 2 includes N sub controlling circuits, such as sub controlling circuit 21, . . . , sub controlling circuit 2N, etc., wherein N is a positive integer which is greater than or equals to 1. Each sub controlling circuit includes a first voltage division resistor, a first field effect transistor, a second field effect transistor and a second voltage division resistor, such as the sub controlling circuit 21 includes a first voltage division resistor 211, a first field effect transistor 212, a second field effect transistor 213 and a second voltage division resistor 214, and a connecting manner of each sub controlling circuit is the same. The description for the sub controlling circuit 21 is given in details as following.

An input terminal of the first voltage division resistor 211 is connected to the output terminal of the gate pulse modulator 1, an output terminal of the first voltage division resistor 211 is connected to a drain of the second field effect transistor 213, a source of the second field effect transistor 213 is connected to a ground, a gate of the second field effect transistor 213 is connected to a drain of the first field effect transistor 212, a source of the first field effect transistor 212 is connected to a ground, a gate of the first field effect transistor 212 is connected to the power source 3, an output terminal of the second voltage division resistor 214 is connected to the drain of the first field effect transistor 212, and an input terminal of the second voltage division resistor 214 is connected to the power source 3.

The first field effect transistor 212 and the second field effect transistor 213 are N channel depletion type field effect transistor. The power source 3 outputs a constant voltage to the second voltage division resistor 214, and the constant voltage is greater than or equals to a conducting threshold of the second field effect transistor 213.

The power source 3 outputs the level signal to the sub controlling circuit 21, when the level signal is greater than or equals to a conducting threshold of the first field effect transistor 212, the first field effect transistor 212 is in a conducting state, and at this time, the gate of the second field effect transistor 213 is equivalent to connect to a ground, and thus the second field effect transistor 213 is in a cut-off state, and the first voltage division resistor 211 is disconnected from the gate pulse modulator 1; when the level signal is less than a conducting threshold of the first field effect transistor 212, the first field effect transistor 212 is in a cut-off state, and at this time, the second field effect transistor 213 is equivalent to connect to the constant voltage, since the constant voltage is greater than or equals to a conduction threshold of the second field effect transistor 213, thus the second field effect transistor 213 is in a conducting state, and the first voltage division resistor 211 is connected to the gate pulse modulator 1.

It should be noted that the liquid crystal display includes the gate driving circuit, and the gate driving circuit can generate a desired gate drive voltage of the liquid crystal display. The gate driving circuit includes the gate pulse modulator 1, the gate pulse modulator 1 is an implementation of a conventional gate driving circuit, by inputting a high level voltage to the gate pulse modulator 1, thereby generating a gate driving voltage. A variety of gate driving voltages may be generated by connecting the controlling circuit 2 and the output terminal of the gate pulse modulator 1. Specifically, each sub controlling circuit controls conduction between each sub controlling circuit and the gate pulse modulator 1 according to the level signal outputted by the power source, so as to control the gate driving circuit to output a plurality of gate driving voltages.

In the embodiment of the present disclosure, a plurality of sub controlling circuits is configured. Each sub controlling circuit control a conduction between each controlling circuit and the pulse voltage modulator according to the level signal outputted by the power source, so as to control the gate driving circuit to output a plurality of gate driving voltages, thereby increasing the display effect of the liquid crystal display.

Figure 5:
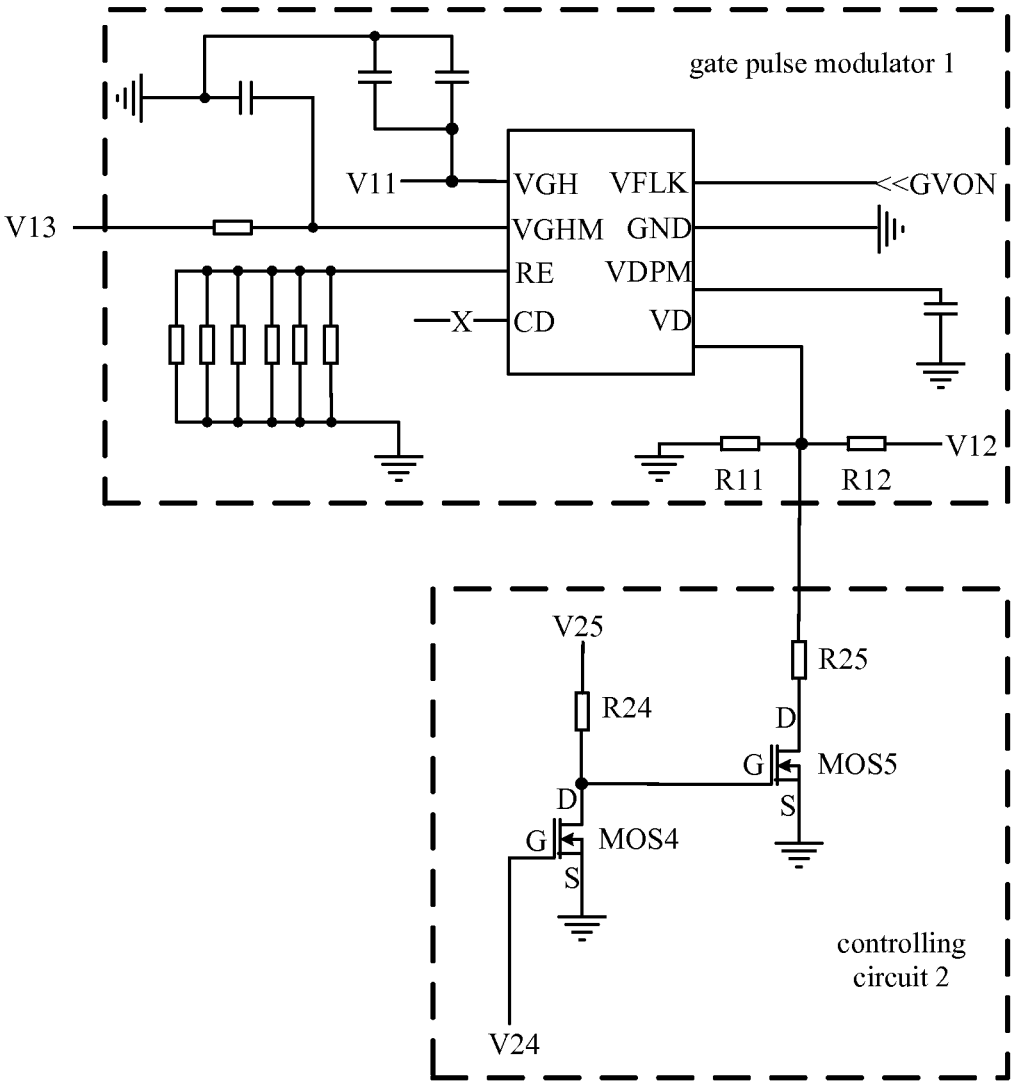
FIG. 5 is a circuit diagram of yet another gate driving circuit according to an embodiment of the present disclosure.

Please refer to FIG. 5. FIG. 5 is a circuit diagram of another gate driving circuit according to an embodiment of the present disclosure. As shown in FIG. 5, it is a circuit diagram of a gate driving circuit provided by a schematic view of the gate driving circuit as shown in FIG. 4. The gate driving circuit includes a gate pulse modulator 1 and a controlling circuit 2. The controlling circuit 2 includes one sub controlling circuit, which includes: a first voltage division resistor R25, a first field effect transistor MOS4, a second field effect transistor MOS5 and a second voltage division resistor R24, wherein MOS4 and MOS5 are N channel depletion type field effect transistor.

The gate pulse modulator 1 is an implementation of a conventional gate driving circuit, by inputting a high level voltage V11 to the whole gate pulse modulator 1, thereby generating a gate driving voltage V13, and a magnitude of V13 is determined according to the voltage division resistors R11 and R12. Therefore, the present disclosure adopts to change the division resistors of the whole gate driving circuit, thereby changing the gate driving voltage V13. A common node of the R11 and R12 in the gate pulse modulator 1 is selected as the output terminal of the gate pulse modulator 1.

An input terminal of R25 is connected to the common node of R11 and R12, an output terminal of R25 is connected to a drain D of MOS5, a source S of MOS5 is connected to a ground, a gate G of MOS5 is connected to a drain D of MOS4, a source S of MOS4 is connected to a ground, a gate G of MOS4 is connected to V24, an output terminal of R24 is connected to the drain D of MOS4, and an input terminal of R24 is connected to V25. V24 is the level signal inputted by the corresponding MOS4, and V25 is the constant voltage.

The conduction threshold of standard N channel MOS transistor is in the range of 3V~6V and the conduction thresholds of MOS4 and MOS5 are assumed as 3V and V25 is assumed as 3.3V. When V24 is 3.3V, MOS4 conducts, i.e. R24 is connected to a ground, a voltage of the drain D of MOS4 is 0V, such that MOS5 does not conduct and is in a cut-off state, therefore R25 is disconnected from the gate pulse modulator 1, so as to generate one gate driving voltage. When V24 is 0V, MOS4 cuts-off, i.e. R24 is disconnected, a voltage of the drain D of MOS4 is 3.3V, such that MOS5 conducts, therefore R25 is connected to the gate pulse modulator 1, so as to generate another gate driving voltage. Therefore, the gate driving circuit can set different level signals for V24, thereby generating different gate drive voltages.

In the embodiment of the present disclosure, a plurality of sub controlling circuits is configured. Each sub controlling circuit controls a conduction between each controlling circuit and the pulse voltage modulator according to the level signal outputted by the power source, so as to control the gate driving circuit to output a plurality of gate driving voltages, thereby increasing the display effect of the liquid crystal display.

Figure 6:
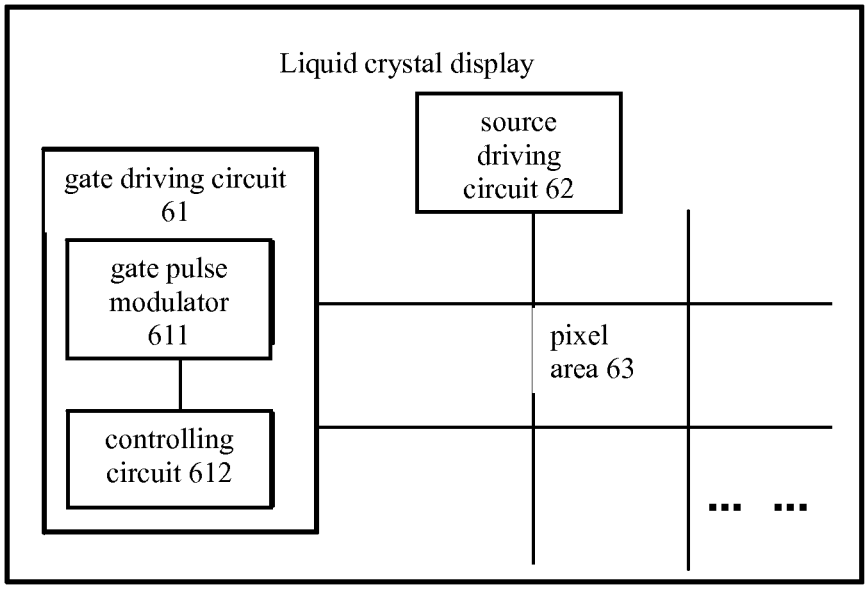
FIG. 6 is a schematic view of a liquid crystal circuit according to an embodiment of the present disclosure.

Please refer to FIG. 6. FIG. 6 is a schematic view of a liquid crystal display according to an embodiment of the present disclosure. As shown in FIG. 6, the liquid crystal display of the embodiment of the present disclosure may include: a gate driving circuit 61, a source driving circuit 62, and a pixel area 63. The gate driving circuit 61 includes a gate pulse modulator 611 and a controlling circuit 612.

The controlling circuit 622 includes at least one sub controlling circuit, an input terminal of each sub controlling circuit of the at least one sub controlling circuit is connected to an output terminal of the gate pulse modulator 611, and an output terminal of each sub controlling circuit is connected to a power source.

The power source outputs a level signal to each sub controlling circuit, each sub controlling circuit controls a conduction between each sub controlling circuit and the gate pulse modulator 611 according to the level signal, so as to control the gate driving circuit 61 to output at least one gate driving voltage.

It should be noted that the liquid crystal display includes the gate driving circuit 61, and the gate driving circuit 61 can generate a desired gate drive voltage of the liquid crystal display.

The gate driving circuit 61 includes the gate pulse modulator 611, and the gate pulse modulator 611 may generate a gate driving voltage. A variety of gate driving voltages may be generated by connecting the controlling circuit 613 and the output terminal of the gate pulse modulator 611. Specifically, each sub controlling circuit controls conduction between each sub controlling circuit and the gate pulse modulator 611 according to the level signal outputted by the power source, so as to control the gate driving circuit 61 to output a plurality of gate driving voltages.

In an embodiment of the present disclosure, a plurality of sub controlling circuits is configured. Each sub controlling circuit controls a conduction between each controlling circuit and the pulse voltage modulator according to the level signal outputted by the power source, so as to control the gate driving circuit to output a plurality of gate driving voltages, thereby increasing the display effect of the liquid crystal display.

Those of ordinary skill should be understood that the implementation of all or part of the processes of the above embodiment methods may be achieved by using hardware related to a computer program instructing, the program may be stored in a computer readable storage medium, and when the program is executed, it may include the processes such as the embodiments of the above methods. The storage medium may be a magnetic disk, an optical disk, a read-only memory (ROM), or a random access memory (RAM), etc.

The above disclosures only are the preferred embodiments of the present disclosure it can not be used to limit the scope of the present disclosure as claimed, Therefore, the equivalent changes is made according to the present disclosure as claimed, the scope of the present disclosure is still covered.

What is claimed is:

1. A gate driving circuit, used to a liquid crystal display, the gate driving circuit comprises a gate pulse modulator, wherein:

the gate driving circuit further comprises a controlling circuit; the controlling circuit comprises at least one sub controlling circuit; an input terminal of the at least one sub controlling circuit is connected to an output terminal of the gate pulse modulator; a control terminal of the at least one sub controlling circuit is connected to a power source;

the power source outputs a level signal to the control terminal of each sub controlling circuit; each sub controlling circuit controls a conduction between each sub controlling circuit and the gate pulse modulator according to the level signal, so as to control the gate driving circuit to output at least one gate driving voltage;

wherein each of the at least one sub controlling circuit comprises a first voltage division resistor and a first field effect transistor, and each of the at least one sub controlling circuit further comprises a second voltage division resistor and a second field effect transistor;

wherein a first terminal of the first voltage division resistor is connected to the output terminal of the gate pulse modulator, a second terminal of the first voltage division resistor is connected to a drain of the second field effect transistor, a source of the second field effect transistor is connected to a ground, a gate of the second field effect transistor is connected to a drain of the first field effect transistor, a source of the first field effect transistor is connected to a ground, a gate of the first field effect transistor is connected to the power source, a second terminal of the second voltage division resistor is connected to the drain of the first field effect transistor, and a first terminal of the second voltage division resistor is connected to the power source.

2. The gate driving circuit according to claim 1, wherein the first field effect transistor and the second field effect transistor are N channel depletion type field effect transistor.

3. The gate driving circuit according to claim 2, wherein the power source outputs a constant voltage to the second voltage division resistor, and the constant voltage is greater than or equals to a conducting threshold of the second field effect transistor;

wherein, when the level signal of each sub controlling circuit is greater than or equals to a conducting threshold of the first field effect transistor, the first field effect transistor is in a conducting state, the second field effect transistor is in a cut-off state, and the first voltage division resistor is disconnected from the gate pulse modulator; when the level signal of each sub controlling circuit is less than a conducting threshold of the first field effect transistor, the first field effect transistor is in a cut-off state, and the second field effect transistor is in a conducting state, the first voltage division resistor is connected to the gate pulse modulator.

4. A liquid crystal display, wherein the liquid crystal display comprises the gate driving circuit according to claim 1.

* * * * *